252-95 AU 166 EX
2/19/80 XR 4,189,396

United States Patent [19]
Brace et al.

[11] 4,189,396
[45] Feb. 19, 1980

[54] DETERGENT COMPOSITIONS

[75] Inventors: Roger Brace; Christopher J. Adams, both of Birkenhead, England

[73] Assignee: Lever Brothers Company, New York, N.Y.

[21] Appl. No.: 907,657

[22] Filed: May 22, 1978

[30] Foreign Application Priority Data

May 25, 1977 [GB] United Kingdom ..... 22067/77

[51] Int. Cl.[2] ..... C11D 7/14; C11D 7/38; C11D 7/56; C11D 7/18

[52] U.S. Cl. ..... 252/99; 252/95; 252/186; 8/111

[58] Field of Search ..... 252/95, 99, 186; 8/111

[56] References Cited

FOREIGN PATENT DOCUMENTS 849747 9/1960 United Kingdom ..... 252/99

*Primary Examiner*—Mayer Weinblatt
*Attorney, Agent, or Firm*—James J. Farrell; Melvin H. Kurtz; Michael J. Kelly

[57] ABSTRACT

This invention relates to detergent compositions which contain an amount of a water-soluble titanium or zirconium peroxo compound which in the composition provides a building and/or bleaching effect.

10 Claims, No Drawings

DETERGENT COMPOSITIONS

BACKGROUND TO THE INVENTION

This invention relates to detergent compositions.

Detergent compositions generally comprise a detergent active, a detergent builder which is used to deactivate water hardness ions such as calcium and magnesium, together with various alkalis and bleaches. Other materials included in detergent compositions can include optical brighteners, foam stabilisers or depressants, perfumes, bleach activators and stabilisers and soil suspension agents.

Other forms of detergent compositions to which this invention may be applied include dish washing formulations which compared with textile formulations contain a lower proportion of detergent active, but still contain builders and bleaches.

A further class of detergent compositions to which the invention may be applied is scourers or hard surface cleaners. These contain a suitable abrasive together with the normal actives, builders, bleaches and the like.

One very well known detergent builder for use in detergent compositions is sodium tripolyphosphate and this and similar compounds have, due to their phosphorus content, been alleged to lead to eutrophication problems in water.

SUMMARY OF THE INVENTION

This invention provides detergent compositions which can be wholly or partly free of phosphorus-containing builders. Furthermore, the invention provides a component for detergent compositions which comprises both a builder and a bleach function in the one component.

In addition, the detergent compositions provided by this invention are catalase resistant.

By the term "catalase resistant" used in this specification, reference is intended to the enzyme catalase and other enzymes which affect hydrogen peroxide by catalysing its decomposition.

The component comprises a water-soluble titanium or zirconium peroxo compound and this, when used in detergent compositions, particularly those normally used for fabric washing which would normally contain bleaches such as perborates, can be used to replace wholly, or in part, both the orthodox builder and bleach.

Accordingly, the present invention provides, in its broadest context, a detergent composition comprising a detergent active and a water-soluble titanium or zirconium peroxo compound in a sufficient quantity to develop a building and/or bleaching action in an aqueous solution of the composition.

When reference is made to a solution of the detergent compositions provided by this invention, it is to be understood to include solutions of compositions comprising both soluble and insoluble components. Such components include scourers and other hard surface cleaners containing significant proportions of water-insoluble abrasives and also insoluble builders such as aluminosilicates.

DETAILED DESCRIPTION OF THE INVENTION

Many suitable detergent active compounds are commercially available for use in the compositions of this invention and they are fully described in the literature, for example, in "Surface Active Agents and Detergents", Volumes I and II, by Schwartz, Perry & Berch. These detergent active compounds may be anionic, nonionic, amphoteric, zwitterionic or cationic, but the preferred compounds are anionic, including soaps, and nonionic.

The detailed formulation of the detergent compositions provided by this invention will depend on their end use, for example, in a composition for use in some types of automatic washing machine, when low foaming is required, a low foam formulation will be employed. The detergent active compounds can also comprise alkali metal soaps of natural or synthetic organic acids. The natural acids derived can be from, for example, tallow or nut oils.

Peroxo titanium and peroxo zirconium compounds of the type used in this invention have been disclosed and reviewed in "Advances in Inorganic and Radio Chemistry", edited by Emeleus and Sharp, published by Wiley in 1964, in the chapter by Connor and Ebsworth, pages 279 to 381. Additional information can be found in "Inorganic Chemistry", Volume 9(11), pages 2381 to 2390, 1970, in the paper entitled "The Peroxo Complexes of Titanium" by Muhlebach, Muller and Schwarzenbach and references therein.

The amount of peroxo compound in the detergent compositions provided by this invention will be determined, at least in part, by the end use of the composition and will generally lie in the range 2 to 90% by weight of the detergent composition. A more preferred range is 5 to 55% by weight.

The titanium and zirconium peroxo compounds used in this invention are susceptible to decomposition by relatively small quantities of transition metals. These metals may be present in the system arising, for example, from impurities in the various components of the detergent composition or from soil on fabrics being washed in the detergent solution or from the water in which the detergent composition has been dissolved. To counter this problem, small quantities of sequestering aids of the type which are currently used in some known detergent compositions are effective. Such sequestering aids include phosphorus-containing organic complexing agents such as alkanepolyphosphonic acids, amino- and hydroxyalkanepolyphosphonic acids, and phosphonocarboxylic acids. An example of this type of compound is sold under the trade name "Dequest". Other suitable sequestering agents having a good complexing capacity for heavy metal ions include ethylene diamine tetraacetic acid (EDTA) and its alkali metal salts.

The peroxo compounds must, as stated earlier, be water-soluble and suitable methods for preparing these peroxo compounds are as follows:

Method 1

Sodium triperoxotitanate, $Na_2Ti(O_2)_3 3H_2O$ 200 mls of 15% $Ti(SO_4)_2$ solution in sulphuric acid and 75 mls of 100 volume (30% $H_2O_2$ were each cooled to $<10°$ C. and mixed in a glass vessel. Sufficient 5 N NaOH was then added to raise the pH to 11.5. This took approximately 180 mls of caustic solution. The addition of 350 mls of methanol caused a yellow oil to separate and collect at the bottom of the vessel. The supernatant liquid was decanted away and the oil dried in a vacuum desiccator. A pale yellow solid with a highly porous structure resulted.

It was also found that a satisfactory method of purifying the product in order to remove sodium sulphate was to redissolve the yellow oil in a small volume of dilute hydrogen peroxide adjusted to pH 11.5. The further addition of alcohol reprecipitated the peroxotitanate which was then recovered as described above.

Analysis of the product by conventional techniques suggested a composition $Na_2Ti(O_2)_3 3H_2O$. The available oxygen content was 21% as measured by permanganate titration and the porous solid was soluble in water.

Method 2

Sodium tetraperoxotitanate, $Na_4Ti(O_2)_4 nH_2O$ 500 mls of 15% $Ti(SO_4)_2$ solution and 200 mls of 30% $H_2O_2$ were each cooled in an ice bath to <10° C. and mixed in a glass vessel. The pH was adjusted to 4 with 5 N NaOH and a yellow precipitate of pertitanic acid formed. The precipitate was washed free of sulphate by decantation. The precipitate was dissolved in 120 mls of 35% $H_2O_2$ which was adjusted to pH 12.5 with 10 N NaOH. Methanol was then added slowly until a white solid had formed. This was collected in a buchner funnel and washed with a solution of 50% methanol in 10% $H_2O_2$ with added NaOH to adjust the pH to 12.5. The filter cake was stored in the cold for several days until large crystals were formed. It was finally dried in a vacuum desiccator.

The analysis of sodium, titanium and peroxide suggested a composition $Na_4Ti(O_2)nH_2O$ where $n \sim 1$. The available oxygen content was 22.6% and the powder was soluble in water.

Method 3

Pertitanic acid - Method of Godar (Belgian Pat. No. 791,503), $Ti(O_2)(OH)_2$

Sufficient 5 N NaOH was added to 200 mls of 15% $Ti(SO_4)_2$ solution to raise the pH to 7. About 80 mls of 30% $H_2O_2$ was added and the pH readjusted to 7. After stirring for 30 minutes the yellow solid was collected on a buchner, washed with water and finally dried in a desiccator. The available oxygen content of the product was 10% and the compound contained about 25% water. This product was not soluble in water.

Method 4

Potassium salt of peroxonitrilotriacetic acid (NTA) complex of titanium, $K_2Ti(O_2)OH(NTA)3H_2O$ 10 g of $Ti(O_2)(OH)_2$ was dissolved in 50 mls of 30% $H_2O_2$ and sufficient KOH to raise the pH to 9.5. 9.6 g of NTA were added and the pH dropped to 6.2. The addition of 3 volumes of methanol caused a yelllow precipitate to form. This was recovered and reprecipitated from methanolic hydrogen peroxide solution and was soluble in water. The available oxygen content was 3.8% by weight by titration with ceric ion.

Method 5

Zirconium peroxo compound 50 mls of 30% $H_2O_2$ were cooled to <10° C. and 16 g of Zr O $Cl_2$ $8H_2O$ added. The pH was adjusted to <12 with 5 N NaOH. After stirring for 30 minutes an equal volume of methanol was added and a white precipitate recovered. The precipitate was dissolved in 10% $H_2O_2$ at pH 13 and reprecipitated with methanol. The product was vacuum dried. It contained 15.3% available oxygen and was soluble in water.

As will be seen from the following examples, the compositions provided by this invention have a further benefit, in that the peroxo compounds used are less susceptible to attack by catalase than the hitherto used sodium perborates or sodium percarbonates. This is of significant benefit in that the bleaching activity is not reduced, or less seriously reduced, in use situations in washing machines and the like, where catalase can be expected to be present. While we do not wish to be bound by theory, it is thought that the peroxo compounds break down to hydrogen peroxide and certain peroxo titanium or zirconium species which may be less sensitive to catalase than the hydrogen peroxide which is normally generated with many orthodox bleaches.

The compositions provided by this invention may contain phosphate-free builders, such as aluminosilicates or alkali metal soaps, or alternatively, they may contain reduced quantities of phosphate-based builders, hence, at least minimising the eutrophication problems. When using complexing builders care must be taken to control the pH of aqueous solutions of the detergent compositions provided by this invention to ensure maximum benefit from the presence of the peroxo compounds.

The detergent compositions provided by this invention may be prepared using orthodox procedures such as spray-drying and granulation. The post-dosing of any selected components to a spray-dried composition may also be employed.

Liquid detergent compositions provided by this invention may be made by dissolving the various components in an aqueous or other suitable medium.

In general terms a detergent composition according to the present invention comprises as a percentage by weight:

| | |
|---|---|
| Detergent actives | 1-30 |
| Orthodox builder | 0-50 |
| Sodium silicate | 0-50 |
| Peroxo titanium or zirconium compound | 2-90 |

Detergent compositions for use in washing textiles according to the present invention will generally lie within the following ranges:

| Formulation I | % by weight |
|---|---|
| Detergent actives | 5-30 |
| Auxiliary builder complexing, precipitating or ion exchange | 0-50 |
| Sodium silicate | 0-10 |
| Perfume and fluorescer | 0-2 |
| Filler (sodium sulphate) | 0-30 |
| Buffer | 0-30 |
| Conventional oxygen bleaches | 0-30 |
| Peroxo titanium or zirconium compound | 2-90 |
| Water | 3-20 |

The invention also provides detergent compositions in which the weight ratio of detergent active compound to titanium or zirconium peroxo compound is in the range 1:49 to 49:1, preferably 1:10 to 10:1.

In addition, this invention provides detergent compositions adapted for machine dishwashing comprising:

| Formulation II | Dishwashing % by weight |
|---|---|
| Detergent actives | 1-3 |
| Auxiliary builder complexing, precipitating or ion exchange | 0-50 |
| Sodium silicate | 0-50 |
| Perfume and fluorescer | 1-5 |
| Buffer | 0-50 |
| Peroxo titanium or zirconium compound | 2-50 |
| Water | 0-10 |

This invention also provides detergent compositions adapted for use as scourers comprising:

| Formulation III | Hard surface % by weight |
|---|---|
| Detergent actives | 2-5 |
| Abrasive | 80-95 |
| Auxiliary builder complexing, precipitating or ion exchange | 0-3 |
| Sodium silicate | 0-4 |
| Perfume and fluorescer | trace |
| Peroxo titanium or zirconium compound | 2-10 |

Experiment 1

Test for bleach activity

The ability of the soluble titanium peroxo complexes to bleach was examined by adding 1 g of each compound prepared according to Methods 1 to 4, to a liter of boiling water, together with a piece of tea-stained bleach test cloth. After 10 minutes the test cloth was removed, rinsed and dried. By comparison with cloth which had been washed in boiling water without any peroxo compound it was observed that a significant improvement in whiteness of the cloth was obtained from the triperoxotitanate, tetraperoxotitanate and the NTA complex. The bleaching was judged to be similar to that obtained with perborate under similar conditions. The insoluble pertitanic acid, produced in accordance with Method 3, produced no significant effect. The zirconium peroxo compound, produced according to Method 5, also produced a noticeable bleaching effect.

Experiment 2

Comparison of the bleaching of sodium triperoxotitanate in clean and catalase-containing systems Pieces of a tea-stained bleach test cloth were washed in a standardised wash testing machine known as a "Tergotometer" in solutions containing 1 g/liter of sodium perborate tetrahydrate or 1 g/liter of sodium triperoxotitanate, produced according to Method 1. These solutions were prepared from distilled water and also from liquors extracted from naturally soiled laundry. The wash liquor had a high catalase activity. The Tergotometer was heated from 25° C. to 85° C. over a period of 60 minutes. The available oxygen content of the test solutions was determined by permanganate titration. The improvement in reflectance ΔR of the tea-stained bleach test cloth was determined as a difference in reflectance values (wavelength X=4600 Å) before and after the wash.

| | Sodium triperoxotitanate | Perborate |
|---|---|---|
| ΔR in clean system | 15.8 | 18.8 |
| ΔR in catalase system | 8.2 | 0.3 |
| Bleach remaining at 85° C. in clean system, as g/l $H_2O_2$ | 0.26 | 0.22 |
| in catalase system (g/l $H_2O_2$) | 0.16 | 0.01 |

Whereas both compounds gave a very good bleach in the absence of catalase, only the peroxotitanate produced a significant effect in wash liquor.

EXAMPLE 1

Detergency and bleaching of a peroxotitanate formulation

A detergent composition comprising:

| | Parts by weight |
|---|---|
| Dobs 055 (Alkyl $C_{12-14}$ benzene sulphonate) | 6 |
| Sodium triperoxotitanate according to Method 1 | 12 |
| Sodium sulphate | 4 |
| Sodium silicate $Na_2O:SiO_2$ | 2 |

was dissolved in water to give an aqueous detergent solution comprising:

Water hardness (g/l)

30° H. Ca $Cl_2$ solution

Temperature range (g/l)

25°-80° C. over 75 minutes

Detergency test cloths as described below were used to evaluate this composition:

| | |
|---|---|
| Tea-stained bleach test cloth | BCl |
| Cotton poplin test cloth soiled with fatty material, egg albumen and inorganic matter | ERTC |
| Test cloth soiled with vacuum cleaner dust | VCD |
| Test cloth soiled with clay | Clay |
| pH | |
| 9.6 measured at the end of the wash. | |

By comparison of the reflectance of test cloths before and after the wash it can be seen that good bleaching and detergency was achieved.

| Test cloth | Initial reflectance | Final reflectance |
|---|---|---|
| BCl | 34.0 | 49.3 |
| ERTC | 35.5 | 76.6 |
| VCD | 24.5 | 48.6 |
| Clay | 48.9 | 71.9 |

EXAMPLE 2

A series of detergent compositions comprising in parts by weight 10 parts Dobs and 10 parts sodium silicate and from 4 to 32 parts of sodium triperoxotitanate and from 7.3 to 48.8 of sodium tripolyphosphate were prepared. Solutions of these various detergent compositions were made up to a concentration of 0.1 g/liter of Dobs and 1.0 g/liter of sodium silicate and the various levels of sodium triperoxotitanate produced by Method 1 (Mol Wt 210) such that the water hardness/-builder ratio varied from 2:1, 1.5:1, 1:1, 1:2, 1:4.

The Examples of this invention were repeated using sodium tripolyphosphate instead of the peroxotitanate and the results are set out below:

| Molar ratio water hardness/ builder | Builder concentration (g/l) | | Reflectance of washed cloth | |
|---|---|---|---|---|
| | Peroxo-titanate | Tri-phosphate | Peroxo-titanate | Tri-phosphate |
| 2:1 | 0.4 | 0.73 | 47.0 | 58.5 |
| 1.5:1 | 0.6 | 1.10 | 46.4 | 65.8 |
| 1:1 | 0.8 | 1.47 | 57.2 | 70.0 |
| 1:2 | 1.6 | 2.94 | 71.2 | 73.1 |
| 1:4 | 3.2 | 5.88 | 73.9 | 73.2 |

These figures show that peroxotitanate in excess of the water hardness reaches the detergency plateau shown by sodium tripolyphosphate (STP). Note that as a result of molecular weight differences 1.8 times less weight of the peroxotitanate compound is required compared to STP, for a particular water hardness/-builder mole ratio and, consequently, on an equal weight basis the peroxotitanate is as effective as triphosphate.

Experiment 3

Precipitation of calcium hardness by sodium triperoxotitanate

A solution was prepared containing 18.5° H Ca/6.5° H Mg in $2.5\times10^{-2}$ M NaCl. The sodium chloride concentration approximates to the level of dissolved salts in a heavy duty wash. Sodium triperoxotitanate, produced as in Experiment 1, was added and stirred for 15 minutes at room temperature. The precipitate was then removed by filtration and the residual concentration of hardness ions analysed by atomic absorption.

| Test | Concentration of sodium triperoxotitanate (g/l) | Final water hardness °H Ca/°HMg |
|---|---|---|
| A | 0.885 | 1.35/5.1 |
| B | 0.676 | 1.00/5.9 |
| C | 0.428 | 4.37/6.5 |

In Test A the filtrate contained excess unreacted titanate whereas in B and C all the titanium complex had precipitated. It is believed that some of the calcium in solution in Test A is as a soluble calcium peroxo titanium complex.

EXAMPLE 3

Illustration of the use of peroxo titanium compound in combination with an aluminosilicate builder The following compositions were compared:

| Conventional formulation | A | Peroxotitanate formulation | B |
|---|---|---|---|
| Dobs 055* | 15% | Dobs 055* | 15% |
| Sodium tri-polyphosphate | 35% | Aluminosilicate** | 40% |
| Sodium carbonate | 12% | Borax | 12% |
| Sodium silicate $Na_2O:SiO_2$ | 8% | Tetraperoxotitanate (Expt.2) | 15% |
| Sodium perborate | 25% | Sodium silicate $Na_2O:3.4SiO_2$ | 8% |

-continued

| Conventional formulation | A | Peroxotitanate formulation | B |
|---|---|---|---|
| Water | 5% | Water | 10% |

*Alkyl ($C_{12-14}$) benzene sulphonate. **4 A zeolite detergent grade

The two formulations were evaluated at 2 g/l dosage in water of 8° Ca/4° Mg hardness in a Tergotometer. Tea-stained test cloths (BCl) were used to monitor bleaching whilst detergency was measured by the response of standard test cloths (Clay and ERTC as used in Example 3). The special advantages of the peroxo titanium compound are seen when catalase is included in the test regime.

The washing process lasted 75 minutes during which time the temperature of the wash liquor was raised from 20° C. to 85° C. The tests were repeated in 24° Ca/6° Mg water with detergent dosage increased to 8 g/l.

The improvements in reflectance, R, for the BCl bleach test cloths are summarized below.

| Formu-lation | Water hardness °H Ca/°H Mg | Formulation dosage g/l | ΔR values Clean system | ΔR values Catalactic system |
|---|---|---|---|---|
| A | 8/4 | 2 | 7.7 | 0.7 |
| B | 8/4 | 2 | 7.8 | 2.8 |
| A | 24/6 | 8 | 12.9 | 0.9 |
| B | 24/6 | 8 | 11.5 | 6.0 |

Whilst comparable bleaching results are obtained in clean systems with peroxotitanate formulation is much superior in catalactic systems.

The detergency test cloths showed excellent cleaning by both formulations with no significant differences under any of the test conditions.

What is claimed is:

1. A detergent composition consisting essentially of a detergent active and a water-soluble titanium or zirconium peroxo compound in a sufficient quantity to develop a building and/or bleaching action in an aqueous solution of the composition.

2. A composition as claimed in claim 1 in which the amount of peroxo compound in the detergent composition is in the range 5 to 55% by weight of the detergent composition.

3. A composition as claimed in claim 1 in which the weight ratio of detergent active compound to titanium or zirconium peroxo compound is in the range 1:49 to 49:1.

4. A composition as claimed in claim 3 in which the weight ratio is in the range 1:10 to 10:1.

5. A detergent composition as claimed in claim 1 consisting essentially of, as a percentage by weight:

| | |
|---|---|
| Detergent actives | 1-30 |
| Orthodox builder | 0-50 |
| Sodium silicate | 0-50 |
| Peroxo titanium or zirconium compound | 2-90 |

6. A textile washing detergent composition consisting essentially of, as a percentage by weight:

| | |
|---|---|
| Detergent actives | 5-30 |
| Auxiliary builder complexing, precipitating or ion exchange | 0-50 |

-continued

| | |
|---|---|
| Sodium silicate | 0–10 |
| Perfume and fluorescer | 0–2 |
| Filler (sodium sulphate) | 0–30 |
| Buffer | 0–30 |
| Conventional oxygen bleaches | 0–30 |
| Peroxo titanium or zirconium compound | 2–90 |
| Water | 3–20 |

7. A dishwashing detergent composition consisting essentially of, as a percentage by weight:

| | |
|---|---|
| Detergent actives | 1–3 |
| Auxiliary builder complexing, precipitating or ion exchange | 0–50 |
| Sodium silicate | 0–50 |
| Perfume and fluorescer | 1–5 |
| Buffer | 0–50 |
| Peroxo titanium zirconium compound | 2–50 |
| Water | 0–10 |

8. A scouring composition consisting essentially of, as a percentage by weight:

| | |
|---|---|
| Detergent actives | 2–5 |
| Abrasive | 80–95 |
| Auxiliary builder complexing precipitating or ion exchange | 0–3 |
| Sodium silicate | 0–4 |
| Perfume and fluorescer | trace |
| Peroxo titanium or zirconium compound | 2–10 |

9. A composition as claimed in claim 1 in which the peroxotitanate is sodium triperoxotitanate.

10. A composition as claimed in claim 1 in which the peroxotitanate is sodium tetraperoxotitanate.

* * * * *